US007827767B2

(12) United States Patent
Bertuzzi et al.

(10) Patent No.: US 7,827,767 B2
(45) Date of Patent: Nov. 9, 2010

(54) METHOD AND PACKING MACHINE FOR COMBINING AN INSERT AND A GROUP OF CIGARETTES

(75) Inventors: Ivanoe Bertuzzi, Casalecchio Di Reno (IT); Roberto Polloni, Modigliana (IT); Michele Squarzoni, Ferrara (IT); Stefano Negrini, Calderara Di Reno (IT); Andrea Biondi, Bologna (IT)

(73) Assignee: G.D Societa' per Azioni, Bologna (IT)

( * ) Notice: Subject to any disclaimer, the term of this patent is extended or adjusted under 35 U.S.C. 154(b) by 207 days.

(21) Appl. No.: 12/144,679

(22) Filed: Jun. 24, 2008

(65) Prior Publication Data

US 2009/0077929 A1 Mar. 26, 2009

(30) Foreign Application Priority Data

Jun. 26, 2007 (IT) ..... BO2007A0439
Aug. 28, 2007 (IT) ..... BO2007A0593

(51) Int. Cl.
*B65B 19/04* (2006.01)

(52) U.S. Cl. ..... 53/444; 53/148

(58) Field of Classification Search ..... 53/148, 53/149, 150, 151, 444
See application file for complete search history.

(56) References Cited

U.S. PATENT DOCUMENTS

| | | | | | |
|---|---|---|---|---|---|
| 3,403,493 | A * | 10/1968 | Focke | 53/151 |
| 3,802,325 | A * | 4/1974 | Bardenhagen et al. | 53/148 |
| 3,869,035 | A * | 3/1975 | Focke | 53/151 |
| 3,917,049 | A * | 11/1975 | Shirai et al. | 53/151 |
| 4,330,976 | A * | 5/1982 | Blackall et al. | 53/151 |
| 4,362,235 | A * | 12/1982 | Erdmann | 53/151 |
| 4,528,801 | A * | 7/1985 | Seragnoli et al. | 53/151 |
| 4,607,477 | A * | 8/1986 | Hinchcliffe et al. | 53/148 |
| 5,524,414 | A * | 6/1996 | Spada et al. | 53/54 |
| 5,540,034 | A * | 7/1996 | Focke | 53/444 |
| 5,548,941 | A * | 8/1996 | Portaro et al. | 53/151 |
| 6,484,867 | B2 * | 11/2002 | Spatafora et al. | 53/444 |
| 2001/0047806 | A1 | 12/2001 | Spatafora et al. | |

* cited by examiner

*Primary Examiner*—Louis K Huynh
(74) *Attorney, Agent, or Firm*—Ladas & Parry LLP

(57) ABSTRACT

A method and packing machine for combining an insert and a group of cigarettes; the group of cigarettes is fed to a first seat of a pocket, which first seat is designed to house the group of cigarettes; the insert is fed to a second seat of the pocket, which second seat is designed to house the insert and is separate from the first seat; and the group of cigarettes and the insert are expelled together from the pocket by a common ejector device, so as to combine the insert with the group of cigarettes.

20 Claims, 8 Drawing Sheets

METHOD AND PACKING MACHINE FOR COMBINING AN INSERT AND A GROUP OF CIGARETTES

TECHNICAL FIELD

The present invention relates to a method and packing machine for combining an insert and a group of cigarettes.

BACKGROUND ART

A packet of cigarettes normally comprises an inner package defined by a group of cigarettes wrapped in a sheet of inner packing material; and an outer package enclosing the inner package, and which may be defined by a sheet of outer packing material folded cup-shaped about the inner package (soft packet of cigarettes), or by a rigid, hinged-lid box formed by folding a rigid blank about the inner package (rigid packet of cigarettes).

A packet of cigarettes may also contain an insert located inside the inner package (typically a protecting member or a collar) or between the inner package and the outer package (typically a collar and/or a coupon).

Supplying the insert is a complicated job, on account of it having to be placed and kept in a precise position on the group of cigarettes (on top of or underneath the sheet of inner packing material) without being glued to the group of cigarettes; and the position of the insert is not stabilized until the outer package (insert located between the inner and outer package) or the sheet of inner packing material (insert located inside the inner package) is folded.

Supplying an insert for insertion inside the inner package, i.e. directly contacting the group of cigarettes, is particularly complicated, on account of the group of cigarettes being unstable in shape and failing to provide an even supporting surface.

Insert supply is also particularly complicated when inserting it between the inner and outer package of a rigid packet of cigarettes having a non-parallelepiped-shaped (e.g. oval or triangular) cross section and formed from a horizontal blank (i.e. in which the panels forming the lateral walls of the packet are connected directly to one another at the longitudinal edges) as opposed to a conventional vertical blank (i.e. in which the panels forming the lateral walls of the packet are not connected to one another directly).

DISCLOSURE OF THE INVENTION

It is an object of the present invention to provide a method and packing machine for combining an insert and a group of cigarettes, which method and packing machine are cheap and easy to implement, and provide for effectively and efficiently feeding an insert onto a group of cigarettes.

According to the present invention, there are provided a method and packing machine for combining an insert and a group of cigarettes, as claimed in the attached Claims.

BRIEF DESCRIPTION OF THE DRAWINGS

A non-limiting embodiment of the present invention will be described by way of example with reference to the accompanying drawings, in which.

PREFERRED EMBODIMENTS OF THE INVENTION

Figure 1:
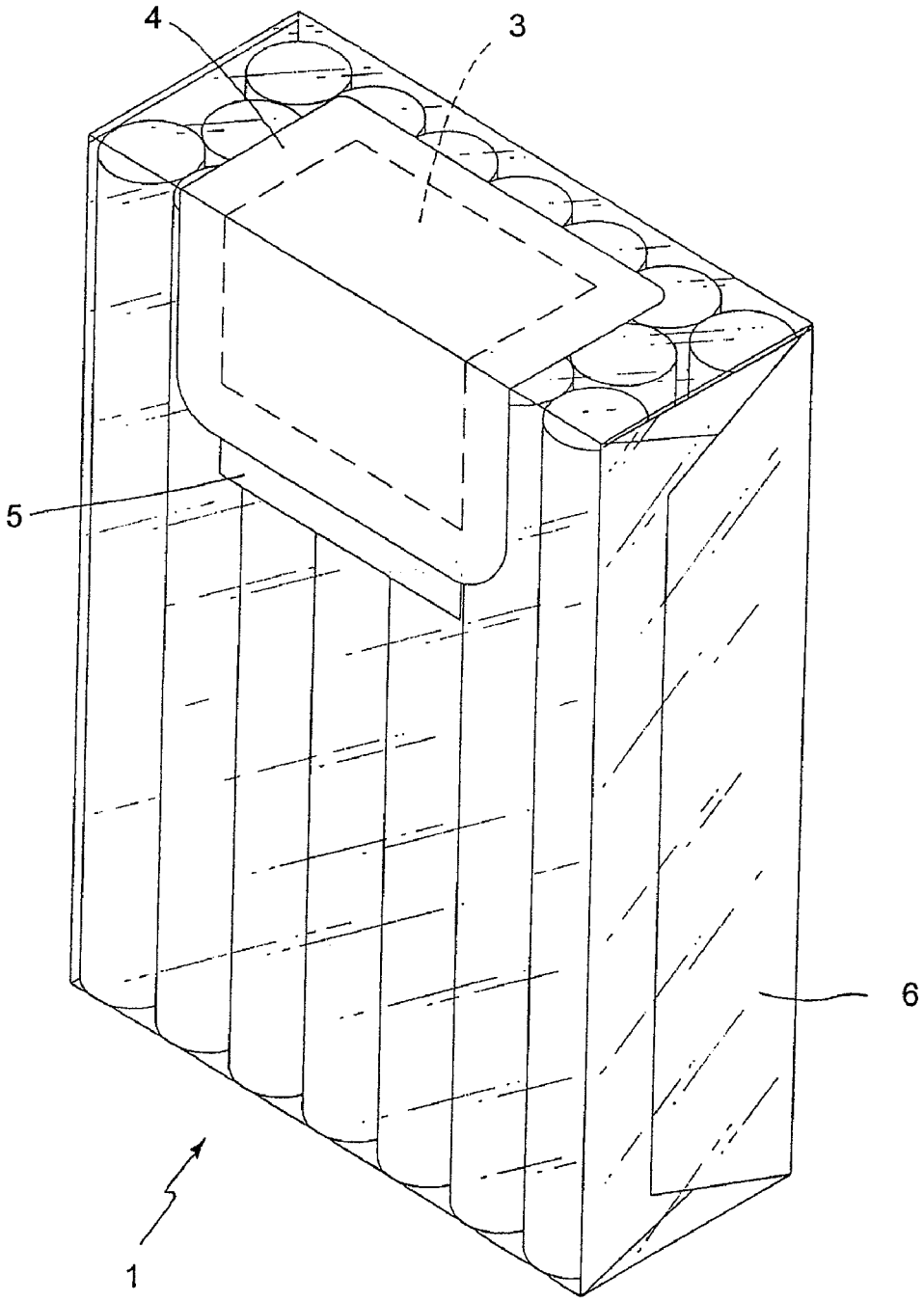
FIG. 1 shows a front view in perspective of a package of cigarettes.

Number 1 in FIG. 1 indicates as a whole a package enclosing a parallelepiped-shaped group 2 of cigarettes and having, at the top and front, a cigarette extraction opening 3 closed by a reusable cover flap 4 and extending over a portion of a front wall of package 1 and a portion of a top wall of package 1.

In a preferred embodiment, cover flap 4 is fixed to package 1 using non-dry, re-stick adhesive which is applied to the underside surface of cover flap 4 and extends about the whole of extraction opening 3, so cover flap 4 can be repeatedly detached partly from and fixed back onto package 1. Cover flap 4 preferably has a bottom grip tab 5 with no re-stick adhesive, and by which to grip and lift cover flap 4.

A package 1 of the type described may be used, for example, in a packet of cigarettes in accordance with U.S. Pat. No. 4,300,676.

In a different embodiment not shown, package 1 has no extraction opening 3 and no cover flap 4, and has a removable top portion separated from the rest of package 1 by a tear line, and which is torn off when package 1 is unsealed. Preferably, package 1 has a tear strip by which to tear open package 1 along the tear line.

Package 1 is formed by folding a rectangular sheet 6 of packing material (FIG. 4), which is made of transparent, airtight, heat-seal plastic material (typically cellophane), and is folded directly about group 2 of cigarettes and in direct contact with the cigarettes. Once sheet 6 of packing material is folded about group 2 of cigarettes to form package 1, the form of package 1 is stabilized by heat sealing the superimposed portions of sheet 6 of packing material.

Before being folded about group 2 of cigarettes, sheet 6 of packing material is cut to define extraction opening 3; and cover flap 4, gummed on the underside, is then applied to sheet 6 of packing material. That is, the underside surface of the cover flap is coated with re-stick adhesive which, inside extraction opening 3, glues the inner portion of sheet 6 of packing material permanently to cover flap 4, and, outside extraction opening 3, glues sheet 6 of packing material detachably to cover flap 4.

Figure 2:
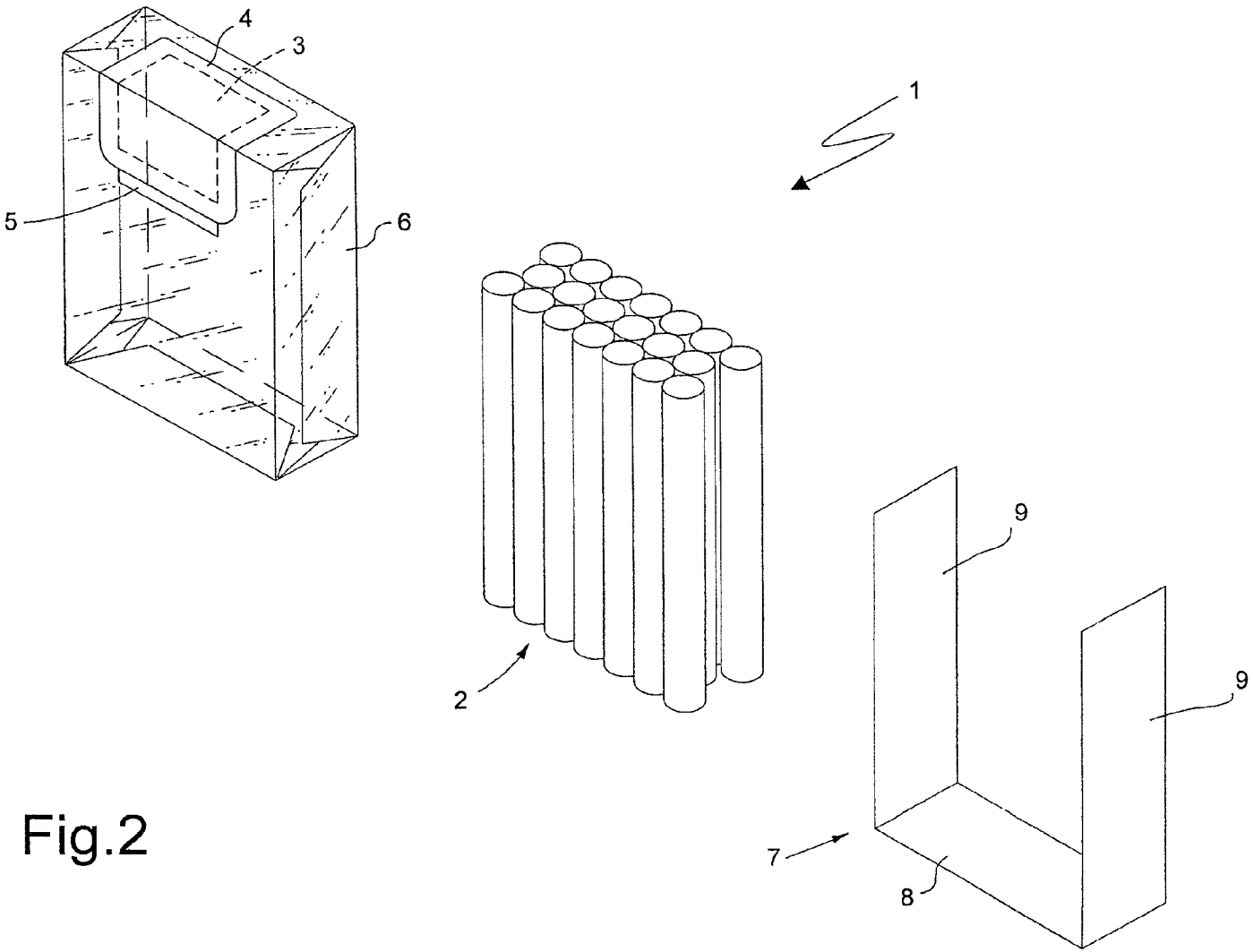
FIG. 2 shows an exploded view in perspective of the FIG. 1 package.

As shown in FIG. 2, package 1 comprises a U-shaped stiffener 7 made of rigid cardboard and inserted inside package 1, in contact with group 2 of cigarettes. Stiffener 7 comprises a rectangular central panel 8 positioned contacting a bottom wall of group 2 of cigarettes defined by the tips of the cigarettes; and two lateral tabs 9 connected to the short sides of central panel 8 along two fold lines, and positioned contacting the minor lateral walls of group 2 of cigarettes defined by the cylindrical lateral walls of the cigarettes.

Stiffener 7 provides for stiffening and maintaining the shape of package 1, to prevent the partly filled package 1 from collapsing and so making it difficult to withdraw the remaining cigarettes and, in particular, to open and close cover flap 4. A further function of stiffener 7 is to provide adequate mechanical protection of the cigarettes when folding sheet 6 of packing material, adequate mechanical and thermal protection of the cigarettes when heat sealing the superimposed portions of sheet 6 of packing material, and adequate mechanical protection of the cigarettes when handling package 1.

Figure 3:
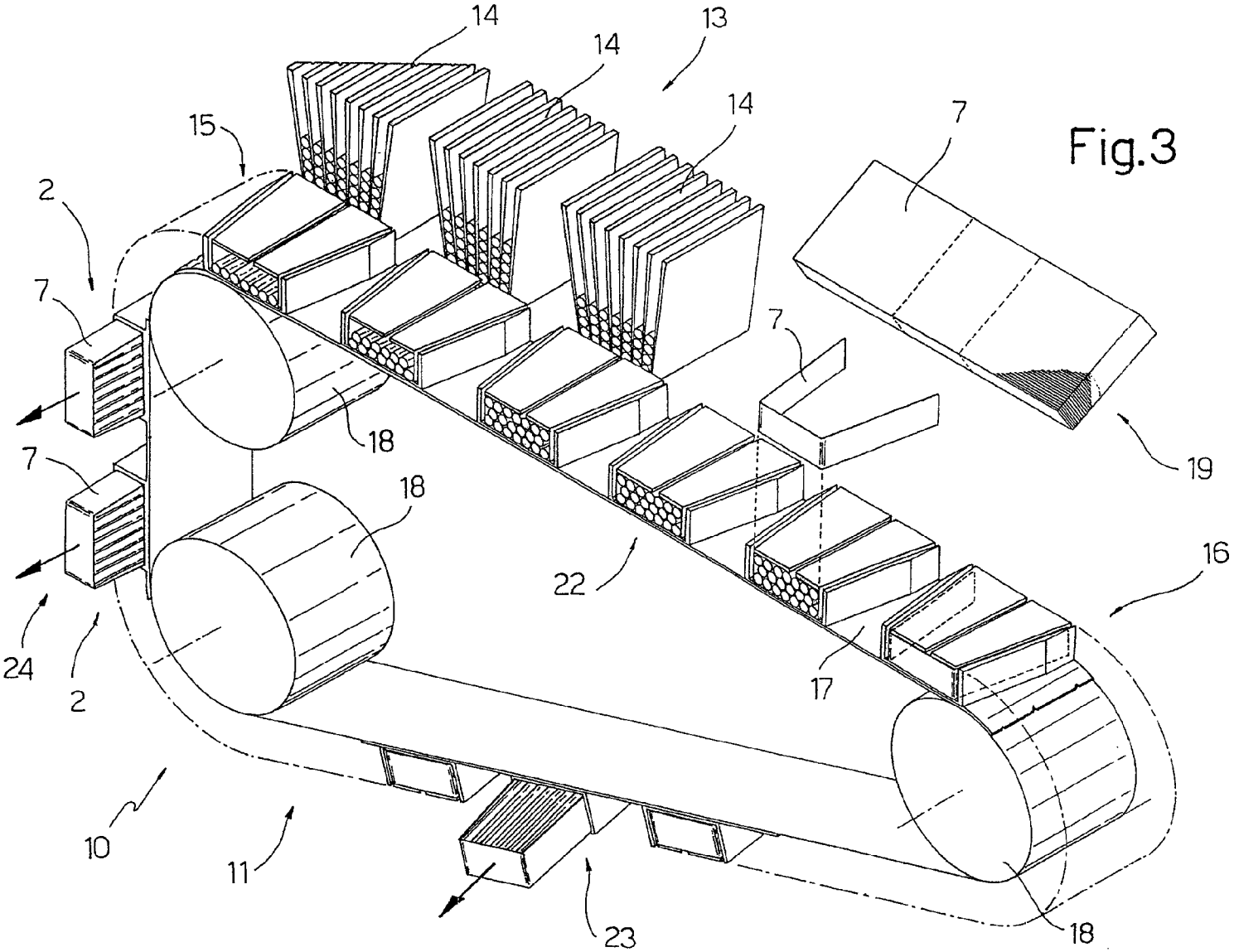
FIG. 3 shows a schematic view in perspective of a group-forming unit of a cigarette packing machine for producing the FIG. 1 package and in accordance with the present invention.
Figures 4, 5:
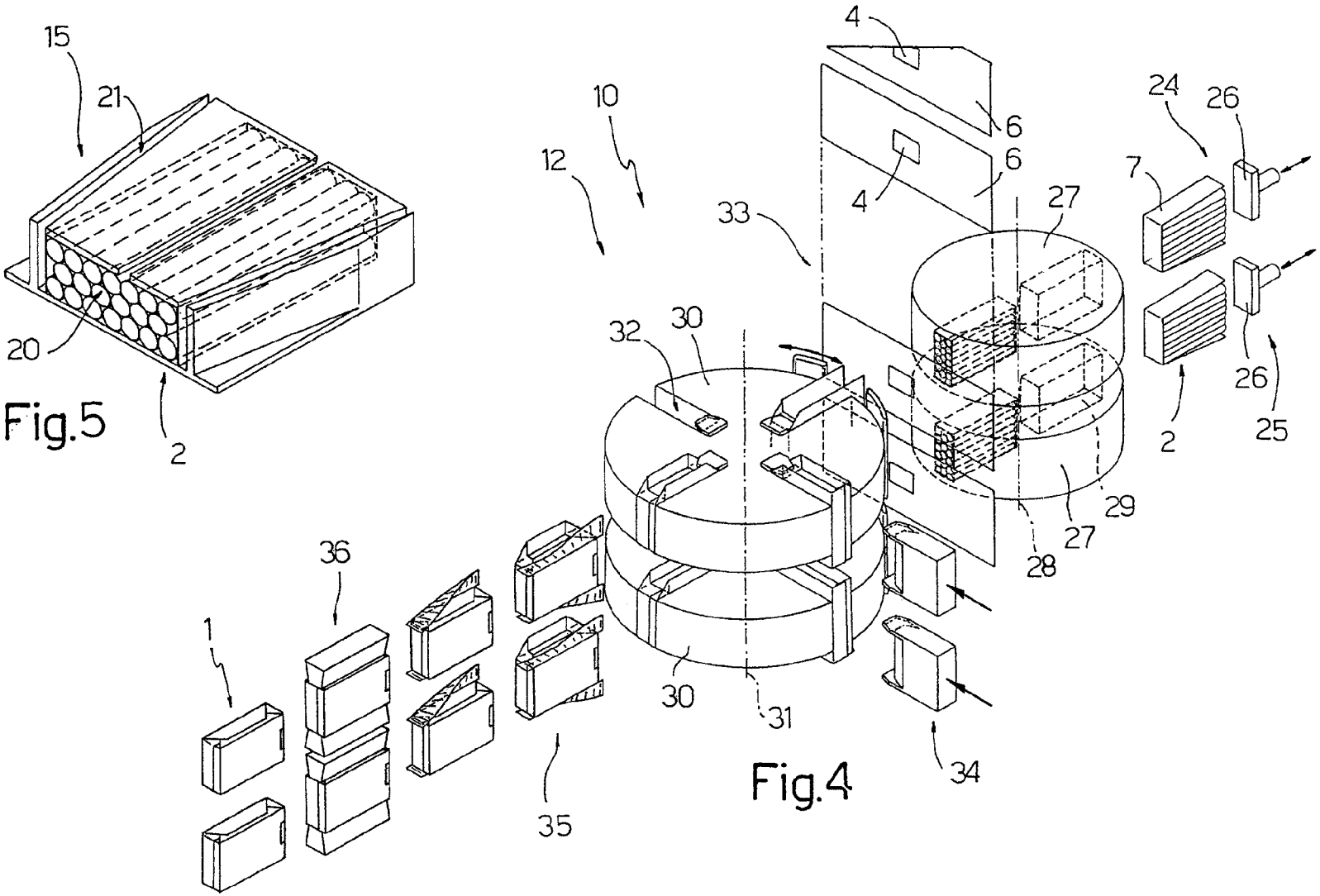
FIG. 4 shows a schematic view in perspective of a packing unit of the FIG. 3 cigarette packing machine.
FIG. 5 shows a larger-scale, schematic view in perspective of a pocket of a group-forming conveyor of the FIG. 3 group-forming unit.

Number 10 in FIGS. 3 and 4 indicates as a whole a packing machine for producing package 1 as described above.

Packing machine 10 comprises a group-forming unit 11 (FIG. 3) for successively forming groups 2 of cigarettes; and a packing unit 12 (FIG. 4) for folding and heat sealing a respective sheet 6 of packing material about each group 2 of cigarettes. It is important to note that packing machine 10 may comprise only group-forming unit 11 and packing unit 12 (in which case, each package 1 described above is a finished retail product), or may comprise a further known packing station for enclosing each package 1 in a respective outer package, which may be defined by a sheet of outer packing material folded cup-shaped about package 1 (soft packet of cigarettes), or by a rigid, hinged-lid box formed by folding a rigid blank about package 1 (rigid packet of cigarettes).

Group-forming unit 11 for forming groups 2 of cigarettes comprises a hopper 13 with at least two outlets 14 for feeding two groups 2 of cigarettes simultaneously to two respective pockets 15 of a group-forming conveyor 16, which supports a number of groups of pockets 15, each comprising two side by side pockets 15. Group-forming conveyor 16 comprises a belt 17 looped about three end pulleys 18 (one of which is powered), and which moves in steps along an endless triangular path.

Group-forming unit 11 also comprises a feed device 19 for supplying stiffeners 7, and which is located along group-forming conveyor 16, downstream from hopper 13 in the travelling direction of group-forming conveyor 16, to simultaneously feed two stiffeners 7 to two respective pockets 15 of group-forming conveyor 16.

Each pocket 15 of group-forming conveyor 16 comprises a seat 20 for housing a respective group 2 of cigarettes; and a seat 21 for housing a respective stiffener 7 (constituting an insert), and which is separate from seat 20. Consequently, hopper 13 feeds each group 2 of cigarettes into seat 20 of a respective pocket 15; and feed device 19 feeds each stiffener 7 into seat 21 of a respective pocket 15.

In variations not shown, each pocket 15 may comprise a number of seats 21 for respective inserts.

In a preferred embodiment, along group-forming conveyor 16 are located a control station 22 for optically checking each group 2 of cigarettes is complete and the tips of the cigarettes in each group 2 are properly filled; and a reject station 23 where any faulty group 2 of cigarettes detected at control station 22 is rejected (e.g. expelled mechanically or pneumatically from respective pocket 15) together with respective stiffener 7. It is important to note that control station 22 is located between hopper 13 and feed device 19, so groups 2 of cigarettes can be checked unconcealed by stiffeners 7; and reject station 23 is located downstream from feed device 19, so a faulty group 2 of cigarettes is rejected together with respective stiffener 7.

Between group-forming unit 11 and packing unit 12, a transfer station 24 transfers groups 2 of cigarettes, complete with respective stiffeners 7, from group-forming unit 11 to packing unit 12. More specifically, at transfer station 24, group-forming unit 11 comprises an ejector device 25 which expels group 2 of cigarettes and respective stiffener 7 together from each pocket 15, so that stiffener 7 is applied to group 2 of cigarettes. It is important to note that ejector device 25 is common to both seats 20 and 21 of the same pocket, i.e. one ejector device 25 simultaneously expels group 2 of cigarettes from seat 20, and respective stiffener 7 from seat 21 of each pocket 15. In the FIG. 4 embodiment, ejector device 25 comprises two pushers 26 for simultaneously transferring two groups 2 of cigarettes fitted with respective stiffeners 7. More specifically, each pusher 26 moves back and forth inside pocket 15 to push out group 2 of cigarettes and respective stiffener 7.

Packing unit 12 comprises two coaxial, superimposed input wheels 27 for simultaneously receiving and conveying two groups 2 of cigarettes, fitted with respective stiffeners 7, from group-forming unit 11. Each input wheel 27 is horizontal, rotates in steps about a common vertical axis of rotation 28, and supports two peripheral pockets 29, each for housing a group 2 of cigarettes fitted with a stiffener 7.

Packing unit 12 also comprises two coaxial, superimposed packing wheels 30 for simultaneously receiving two groups 2 of cigarettes fitted with respective stiffeners 7 and partly wrapped in respective U-folded sheets 6 of packing material. Each packing wheel 30 is horizontal, rotates in steps about a common vertical axis of rotation 31, and supports two peripheral pockets 32, each for housing a group 2 of cigarettes fitted with a stiffener 7 and wrapped partly in a respective sheet 6 of packing material.

At a feed station 33 between the two input wheels 27 and the two packing wheels 30, two sheets 6 of packing material are fed simultaneously along a vertical feed path and intercepted by two groups 2 of cigarettes, fitted with respective stiffeners 7, being transferred from the two input wheels 27 to the two packing wheels 30. Each group 2 of cigarettes, fitted with respective stiffener 7, thus intercepts the corresponding sheet 6 of packing material on the inside, and folds sheet 6 of packing material into a U as it is transferred from a pocket 29 on input wheel 27 to a pocket 32 on packing wheel 30.

Each packing wheel 30 has known fixed and movable folding members (not shown) for folding the ends of each sheet 6 of packing material about respective group 2 of cigarettes and on top of respective stiffener 7 to form package 1; and a sealing device 34 for heat sealing the superimposed end portions of each sheet 6 of packing material.

Packing unit 12 also comprises two straight folding devices 35, each for receiving an unfinished package 1 from a respective packing wheel 30, and for folding the sides of respective sheet 6 of packing material about respective group 2 of cigarettes and on top of respective stiffener 7 to complete package 1. Each folding device 35 preferably comprises fixed helical folding members. Two sealing devices 36 are located immediately downstream from each folding device 35 to heat seal the superimposed lateral portions of each sheet 6 of packing material.

As stated, a group 2 of cigarettes is fed into a seat 20 of a pocket 15, a stiffener 7 is then fed into a seat 21 of pocket 15, and the group 2 of cigarettes and stiffener 7 are combined when expelled together and simultaneously from pocket 15 by a common ejector device 25.

In the FIG. 3 embodiment, seat 21 of each pocket 15 is located in front of seat 20 in the travelling direction of ejector device 25, so that the group 2 of cigarettes pushed out of seat 20 by ejector device 25 contacts and pushes stiffener 7 out of seat 21 to expel stiffener 7 from seat 21.

In the FIG. 3 embodiment, each stiffener 7 is folded before being inserted inside seat 21 of respective pocket 15; and seat 21 of each pocket 15 is obviously designed to accommodate the folded stiffener 7. Normally, each stiffener 7 is folded partly before being inserted inside seat 21 of respective pocket 15, and is folded completely onto group 2 of cigarettes after (or even when) expelling stiffener 7 and group 2 of cigarettes from pocket 15. The reason stiffener 7 is inserted partly folded inside seat 21 of respective pocket 15 lies in seat 21 being located slightly apart from seat 20, and therefore being larger than seat 20, whereas stiffener 7 is sized to fit closely about group 2 of cigarettes, with no appreciable slack, when fully folded.

Preferably, lateral tabs 9 of each stiffener 7 are folded with respect to central panel 8 and about the two fold lines by an angle of at least 60° before stiffener 7 is inserted inside seat 21 of respective pocket 15, and are subsequently folded squarely with respect to central panel 8 about the two fold lines and onto group 2 of cigarettes after stiffener 7 and group 2 of cigarettes are expelled from pocket 15.

Figure 6:
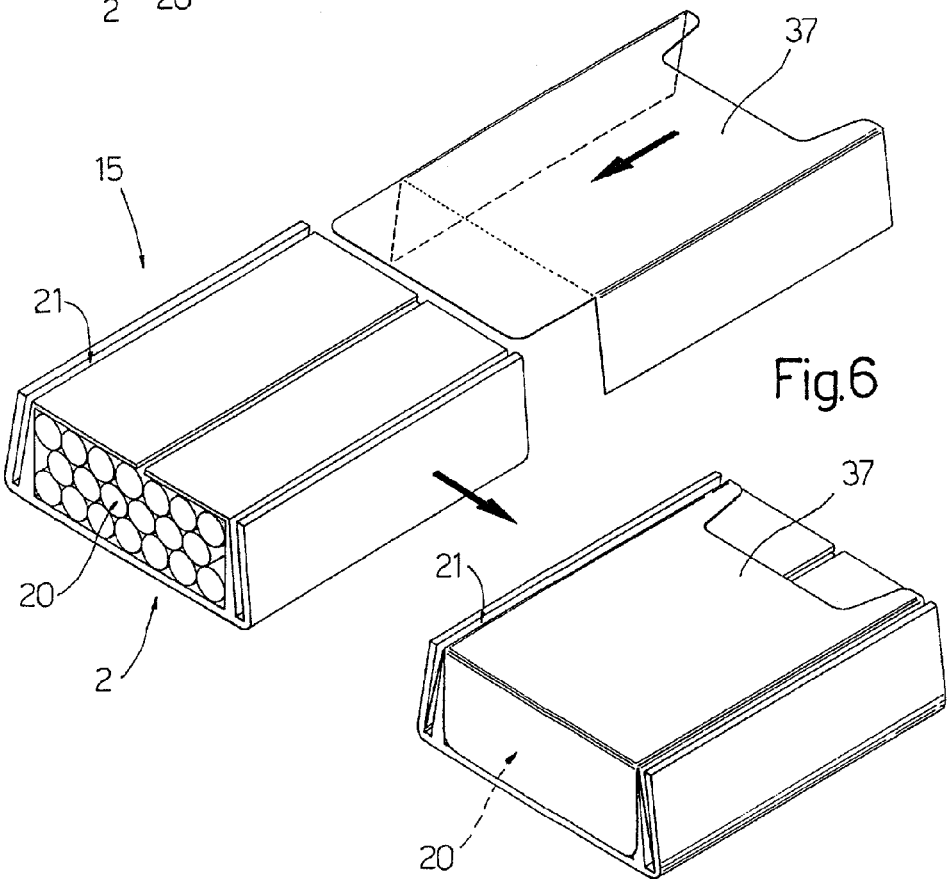
FIG. 6 shows a schematic view in perspective of a different embodiment of the FIG. 5 pocket.

FIG. 6 shows a different embodiment of a pocket 15 designed to receive a collar 37 as opposed to stiffener 7 as described above. In other words, in this embodiment, package 1 contains collar 37 as opposed to stiffener 7. The FIG. 6 and FIG. 5 pockets 15 differ as to the design and location of seat 21 (for receiving stiffener 7 in the FIG. 5 embodiment, and collar 37 in the FIG. 6 embodiment), whereas seat 20 remains unchanged.

Figure 7:
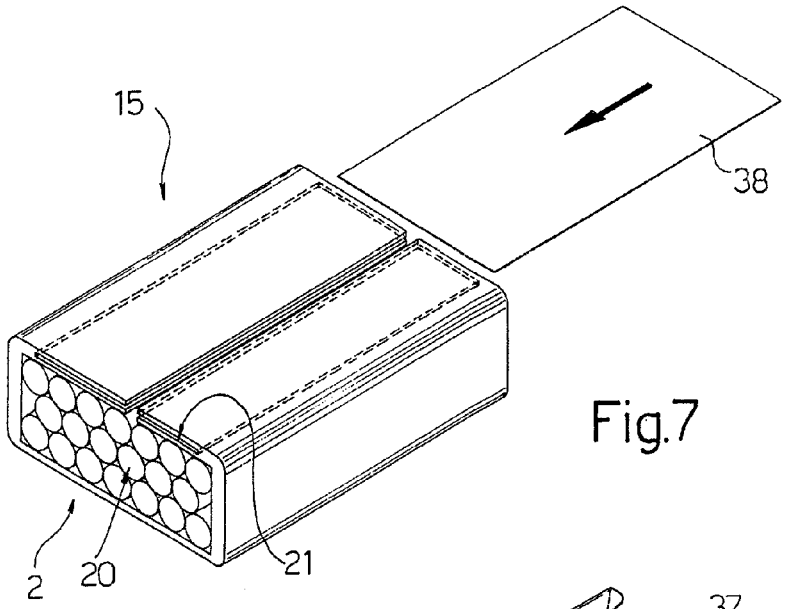
FIG. 7 shows a schematic view in perspective of a further embodiment of the FIG. 5 pocket.

FIG. 7 shows a further embodiment of a pocket 15 designed to receive a coupon 38 as opposed to stiffener 7 as described above. In other words, in this embodiment, package 1 contains coupon 38 as opposed to stiffener 7. The FIG. 7 and FIG. 5 pockets 15 differ as to the design and location of seat 21 (for receiving stiffener 7 in the FIG. 5 embodiment, and coupon 38 in the FIG. 7 embodiment), whereas seat 20 remains unchanged.

In the FIGS. 6 and 7 embodiments, seat 21 of each pocket 15 is parallel to seat 20 in the travelling direction of ejector device 25, which in this case acts on both seats 20 and 21 to push group 2 of cigarettes and collar 37 simultaneously out of both seats 20 and 21. Preferably, each pusher of ejector device 25 comprises a first push member which is inserted inside seat 20, and a second push member integral with the first push member and which is inserted inside seat 21.

Figure 8:
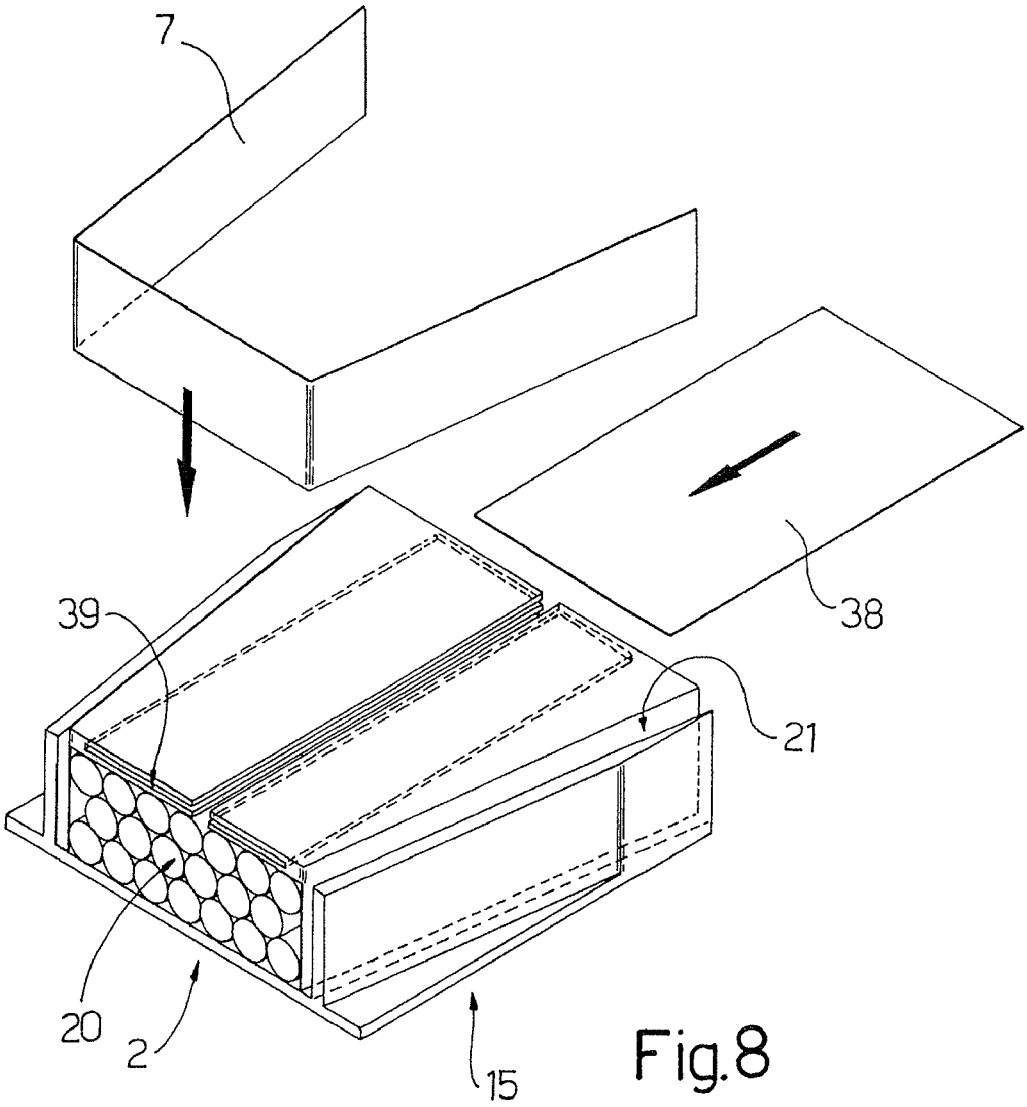
FIG. 8 shows a schematic view in perspective of a further embodiment of the FIG. 5 pocket.
Figure 9:
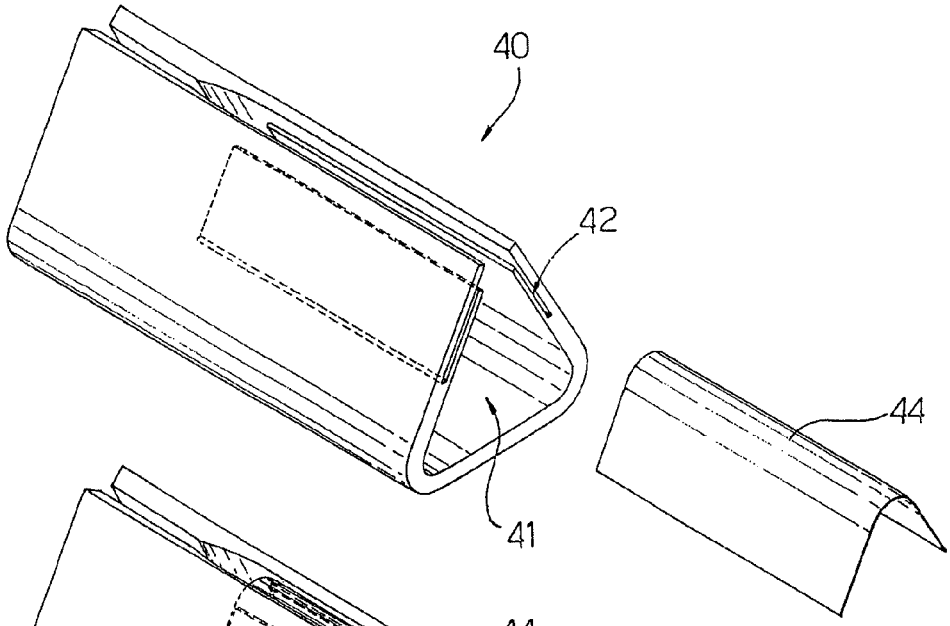
FIGS. 9-13 show five schematic views in perspective of a pocket of another packing machine in accordance with the present invention and for producing rigid, hinged-lid, triangular-section packets of cigarettes.
Figure 10:
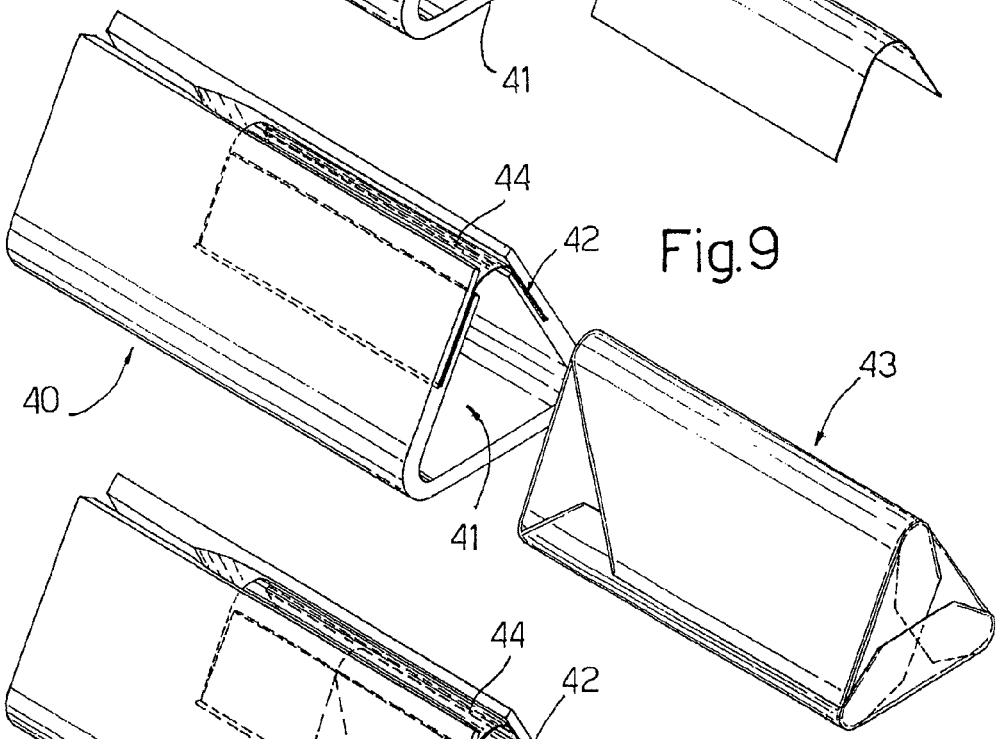
Figure 11:
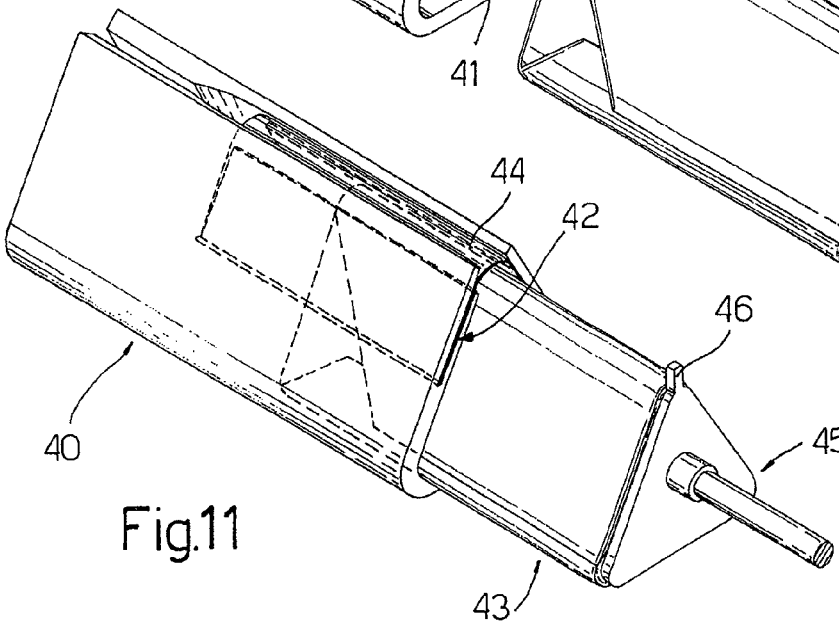
Figure 12:
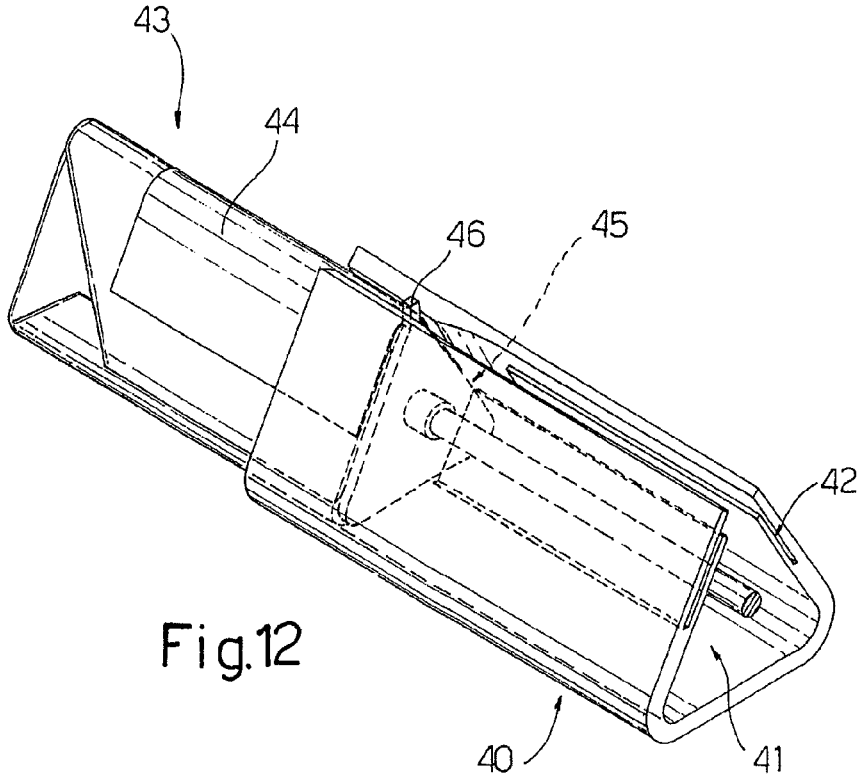
Figure 13:
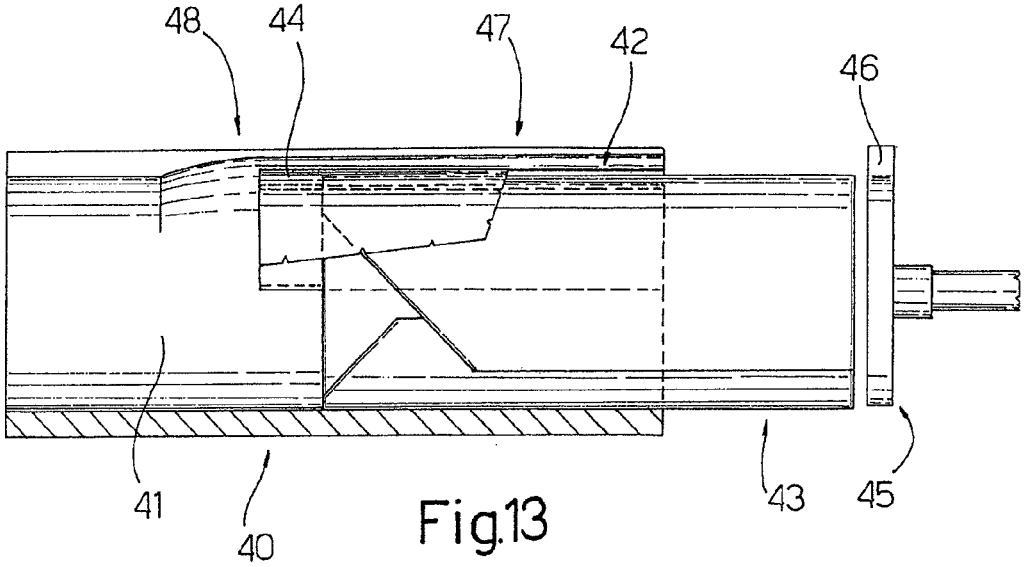

FIG. 8 shows a further embodiment of a pocket 15 designed to receive both a stiffener 7 and a coupon 38. In other words, in this embodiment, package 1 contains both coupon 38 and stiffener 7. The FIG. 8 and FIG. 5 pockets 15 differ by the FIG. 8 pocket 15 comprising an additional seat 39 separate from and alongside seats 20 and 21 and for housing coupon 38. In this case, a further feed device feeds coupons 38 successively into seats 39 of pockets 15, and the common ejector device 25 expels group 2 of cigarettes, stiffener 7, and coupon 38 together and simultaneously from each pocket 15, so as to combine stiffener 7 and coupon 38 with group 2 of cigarettes.

FIGS. 9-13 show a pocket 40 of another packing machine (not shown) for producing rigid, hinged-lid, triangular-section packets of cigarettes. Pocket 40 has a triangular-section seat 41 for housing a triangular group 43 of cigarettes wrapped in a sheet of foil inner packing material; and a seat 42 alongside and separate from seat 41, and for housing a coupon 44.

In the FIG. 9-13 embodiment, seat 42 is parallel to seat 41 in the travelling direction of an ejector device 45, which in this case acts on both seats 41 and 42 to push group 43 of cigarettes and coupon 44 simultaneously out of both seats 41 and 42. Preferably, ejector device 45 comprises a first push member 46 which is inserted inside seat 41 to push group 43 of cigarettes out of seat 41, and a second push member integral with first push member 46 and which is inserted inside seat 42 to push coupon 44 out of seat 42.

In the FIG. 9-13 embodiment, seat 42 has an inlet portion 47 for receiving and housing coupon 44 and parallel to seat 41; and an outlet portion 48, along which coupon 44 is expelled, and which converges with seat 41 to guide coupon 44 onto group 43 of cigarettes.

The method and packing machine described above have the major advantages of feeding an insert (stiffener 7, collar 37, coupon 38 or 44, or other inserts) easily, precisely, and reliably onto a group 2 or 43 of cigarettes. It is important to note that the method and packing machine described above provide for achieving high output rates (even over 800 packets of cigarettes a minute) with no noticeable loss in precision or reliability.

The invention claimed is:

1. A method of combining an insert (7; 37; 38; 44) and a group (2; 43) of cigarettes; the method comprising the steps of:

feeding the group (2; 43) of cigarettes to a first seat (20; 41) of a pocket (15; 40), which first seat (20; 41) is designed to house the group (2; 43) of cigarettes;

feeding an insert (7; 37; 38; 44) to a second seat (21; 42) of the pocket (15; 40), which second seat (21; 42) is designed to house the respective insert (7; 37; 38; 44) and is separate from the first seat (20; 41) so that the group (2; 43) of cigarettes in the first seat (20; 41) of the pocket (15; 40) is completely separated and independent from the insert (7; 37; 38; 44) in the second seat (21; 42) of the pocket (15; 40); and expelling the group (2; 43) of cigarettes and the insert (7; 37; 38; 44) together from the pocket (15; 40) by means of an ejector device (25; 45) directly pushing the group (2; 43) of cigarettes, so as to combine the insert (7; 37; 38; 44) with the group (2; 43) of cigarettes only when both the insert (7; 37; 38; 44) and the group (2; 43) of cigarettes are expelled from the respective first seat (20; 41) and second seat (21; 42) of the pocket (15; 40).

2. A method as claimed in claim 1, wherein the second seat (21; 42) is located in front of the first seat (20; 41) in the travelling direction of the ejector device (25; 45), so that the group (2; 43) of cigarettes pushed out of the first seat (20; 41) by the ejector device (25; 45) contacts and pushes the insert (7; 37; 38; 44) out of the second seat (21; 42) to expel the insert (7; 37; 38; 44) from the second seat (21; 42).

3. A method as claimed in claim 1, wherein the second seat (21; 42) is parallel to the first seat (20; 41) in the travelling direction of the ejector device (25; 45); and the ejector device (25; 45) acts on both seats (20, 21) to push the group (2; 43) of cigarettes and the insert (7; 37; 38; 44) simultaneously out of both seats (20, 21).

4. A method as claimed in claim 3, wherein the ejector device (25; 45) has a first push member (46) which is inserted inside the first seat (20; 41); and a second push member integral with the first push member (46) and which is inserted inside the second seat (21; 42).

5. A method as claimed in claim 4, wherein the second seat (21; 42) has an inlet portion (47) for receiving and housing the insert (7; 37; 38; 44) and parallel to the first seat (20; 41); and an outlet portion (48) along which the insert (7; 37; 38; 44) is expelled, and which converges with the first seat (20; 41) to guide the insert (7; 37; 38; 44) onto the group (2; 43) of cigarettes.

6. A method as claimed in claim 1, and comprising the further step of folding the insert (7; 37; 38; 44) before inserting the insert (7; 37; 38; 44) inside the second seat (21; 42), which is designed to receive the folded insert (7; 37; 38; 44).

7. A method as claimed in claim 6, and comprising the further steps of:

partly folding the insert (7; 37; 38; 44) before inserting the insert (7; 37; 38; 44) inside the second seat (21; 42), which is designed to receive the partly folded insert (7; 37; 38; 44); and fully folding the insert (7; 37; 38; 44) onto the group (2; 43) of cigarettes, after expelling the insert (7; 37; 38; 44) and the group (2; 43) of cigarettes from the pocket (15; 40).

8. A method as claimed in claim 7, wherein the insert (7; 37; 38; 44) has at least a central panel (8), and two lateral tabs (9) separated from the central panel (8) by two fold lines; the lateral tabs (9) are folded with respect to the central panel (8) and about the two fold lines by an angle of at least 60.degree. before the insert (7; 37; 38; 44) is inserted inside the second seat (21; 42), and are subsequently folded squarely with respect to the central panel (8) about the two fold lines and onto the group (2; 43) of cigarettes after the insert (7; 37; 38; 44) and the group (2; 43) of cigarettes are expelled from the pocket (15; 40).

9. A method as claimed in claim 1, wherein the insert (7; 37; 38; 44) is defined by a stiffener (7) having at least a central panel (8) which is positioned contacting a bottom wall, defined by the ends of the cigarettes, of the group (2; 43) of cigarettes.

10. A method as claimed in claim 9, wherein the stiffener (7) has two lateral tabs (9) separated from the central panel (8) by two fold lines, and which are positioned contacting two lateral walls, defined by the lateral walls of the cigarettes, of the group (2; 43) of cigarettes.

11. A method as claimed in claim 1, wherein the insert (7; 37; 38, 44) is defined by a collar (37).

12. A method as claimed in claim 1, and comprising the further steps of:

feeding a further insert (38) to a third seat (39) of the pocket (15; 40), which third seat (39) is designed to house the further insert (38) and is separate from the first seat (20; 41) and the second seat (21; 42);

expelling the group (2; 43) of cigarettes and the two inserts (7; 37; 38; 44) together from the pocket (15; 40) by means of the ejector device (25; 45), so as to combine both inserts (7; 37; 38; 44) with the group (2; 43) of cigarettes.

13. A method as claimed in claim 12, wherein the further insert (38) is defined by a coupon (38; 44).

14. A packing machine for combining an insert (7; 37; 38; 44) and a group (2; 43) of cigarettes; the packing machine (10) comprising:

a pocket (15; 40) having a first seat (20; 41) for housing the group (2; 43) of cigarettes, and a second seat (21; 42) for housing the insert (7, 37; 38; 44) and which is separate from the first seat (20; 41) so that the group (2; 43) of cigarettes in the first seat (20; 41) of the pocket (15; 40) is completely separated and independent from the insert (7; 37; 38; 44) in the second seat (21; 42) of the pocket (15; 40);

a first feed device (13) for feeding the group (2; 43) of cigarettes to the first seat (20; 41) of the pocket (15; 40);

a second feed device (19) for feeding the insert (7; 37; 38; 44) to the second seat (21; 42) of the pocket (15; 40); and an ejector device (25; 45) directly pushing the group (2; 43) of cigarettes for expelling the group (2; 43) of cigarettes and the insert (7; 37; 38; 44) from the pocket (15; 40), so as to combine the insert (7; 37; 38, 44) with the group (2; 43) of cigarettes only when both the insert (7; 37; 38; 44) and the group (2; 43) of cigarettes are expelled from the respective first seat (20; 41) and second seat (21; 42) of the pocket (15; 40).

15. A packing machine as claimed in claim 14, wherein the second seat (21; 42) is located in front of the first seat (20; 41) in the travelling direction of the ejector device (25; 45), so that the group (2; 43) of cigarettes pushed out of the first seat (20; 41) by the ejector device (25; 45) contacts and pushes the insert (7; 37; 38; 44) out of the second seat (21; 42) to expel the insert (7; 37; 38; 44) from the second seat (21; 42).

16. A packing machine as claimed in claim 14, wherein the second seat (21; 42) is parallel to the first seat (20; 41) in the travelling direction of the ejector device (25; 45); and the ejector device (25; 45) acts on both seats (20, 21) to push the group (2; 43) of cigarettes and the insert (7; 37; 38; 44) simultaneously out of both seats (20, 21).

17. A packing machine as claimed in claim 16, wherein the ejector device (25; 45) has a first push member (46) which is inserted inside the first seat (20; 41); and a second push member integral with the first push member (46) and which is inserted inside the second seat (21; 42).

18. A packing machine as claimed in claim 17, wherein the second seat (21; 42) has an inlet portion (47) for receiving and housing the insert (7; 37; 38; 44) and parallel to the first seat (20; 41); and an outlet portion (48) along which the insert (7; 37; 38; 44) is expelled, and which converges with the first seat (20; 41) to guide the insert (7; 37; 38; 44) onto the group (2; 43) of cigarettes.

19. A packing machine as claimed in claim 14, and comprising a folding device for folding the insert (7; 37; 38; 44) before the insert (7; 37; 38; 44) is inserted inside the second seat (21; 42), which is designed to receive the folded insert (7; 37; 38; 44).

20. A packing machine as claimed in claim 14, wherein the pocket (15; 40) has a third seat (39) designed to house a further insert (38) and which is separate from the first seat (20; 41) and the second seat (21; 42); a third feed device feeds the further insert (38) to the third seat (39) of the pocket (15; 40); and the ejector device (25; 45) expels the group (2; 43) of cigarettes and the two inserts (7; 37; 38; 44) together from the pocket (15; 40), so as to combine both inserts (7; 37; 38; 44) with the group (2; 43) of cigarettes.

* * * * *